United States Patent [19]

Barrash

[11] Patent Number: 4,705,186

[45] Date of Patent: Nov. 10, 1987

[54] CAN END ASSEMBLY

[75] Inventor: Marshall J. Barrash, Atlanta, Ga.

[73] Assignee: The Coca-Cola Company, Atlanta, Ga.

[21] Appl. No.: 932,353

[22] Filed: Nov. 19, 1986

[51] Int. Cl.[4] ..... B65D 41/32

[52] U.S. Cl. ..... 220/269; 220/260; 220/270; 220/271

[58] Field of Search ..... 220/254, 260, 270, 307, 220/269, 271

[56] References Cited

U.S. PATENT DOCUMENTS

| | | | |
|---|---|---|---|
| 3,083,858 | 4/1963 | Biedenstein . | |
| 3,262,612 | 7/1966 | Tabor . | |
| 3,373,895 | 3/1968 | Arfert | 220/269 |
| 3,441,167 | 4/1969 | Balocca . | |
| 3,744,662 | 7/1973 | Zundel . | |
| 3,757,989 | 9/1973 | Brown | 220/269 |
| 3,807,595 | 4/1974 | Zundel . | |
| 3,830,399 | 8/1974 | Hill | 220/270 |
| 3,847,300 | 11/1974 | Waters | 220/269 |
| 3,856,184 | 12/1974 | Luviano . | |
| 3,952,911 | 4/1976 | Bozek et al. | 220/307 |
| 4,055,275 | 10/1977 | Gontar | 220/270 |
| 4,141,464 | 2/1979 | Kelley et al. | 220/270 |
| 4,184,605 | 1/1980 | Hanson | 220/270 |
| 4,189,060 | 2/1980 | Trotman, III | 220/270 |
| 4,203,528 | 5/1980 | Hasegawa | 220/269 |
| 4,234,099 | 11/1980 | Tarro | 220/270 |
| 4,322,016 | 3/1982 | Barrash . | |
| 4,356,929 | 11/1982 | Müller-Kühn et al. . | |
| 4,397,403 | 8/1983 | Guimarin | 220/269 |
| 4,403,709 | 9/1983 | Meins et al. . | |
| 4,564,121 | 1/1986 | Brochmann . | |
| 4,572,398 | 2/1986 | Juty | 220/307 |
| 4,576,306 | 3/1986 | Kelsey et al. | 220/307 |
| 4,582,216 | 4/1986 | Byrd | 220/260 |

*Primary Examiner*—Stephen Marcus
*Assistant Examiner*—Nova Stucker
*Attorney, Agent, or Firm*—Birch, Stewart, Kolasch & Birch

[57] ABSTRACT

A can end assembly formed from interconnected elements of a cover portion, a tear-shaped seal member and a pull member. This assembly encloses an end of a container, such as a beverage can. The cover portion has a dispensing opening and vent and a pivotable connection to one end of the seal member. The other end of the seal member is pivotably connected to the pull member. In a first position, the seal member will close the opening and will be beneath the pull member. Upon a slight lifting of the pull member, a seal between the seal member and opening will be broken. Continued movement of the pull member causes the seal member to rotate 180 degrees about its connection to the cover portion. During this movement, the pull member also rotates 180 degrees about its longitudinal axis and is displaced about 90 degrees relative to its initial orientation. This movement results in the seal member being positioned above the pull member and in these two elements being in an open, out of the way location to permit a consumer to empty the container. This movement may be reversed to temporarily reseal the container. In the open position, the seal and pull members may be temporarily locked beneath a flange partially surrounding the cover portion. A score line is provided beneath the cover portion to accommodate compression forces. A groove extends around the periphery of the cover portion to permit the can end assembly to snap onto the can body.

10 Claims, 12 Drawing Figures

CAN END ASSEMBLY

BACKGROUND OF THE INVENTION

1. Field of the Invention

The present invention relates to a can end assembly for covering an end of a container. More specifically, the present invention relates to a plastic assembly having a cover portion for covering one end of a metal beverage can, a tear-shaped seal means for closing an opening in the covering portion, and a pull member for aiding movement of the seal means between an open and a closed position. The covering means, seal means, and pull member are all interconnected in such a manner so as to be moveable relative to one another. This movement permits the seal means to move from a position where it closes the opening in the cover portion to an out of the way position for permitting removal of the contents of the container.

2. Description of the Background Art

Various closure means are known for conventional can end assemblies. For instance, a foil may extend over one end of the can covering an opening therein. This foil may be attached to the can by a hot melt glue seal on one of its ends, while the other end remains unattached to the can end. This unattached end permits a user to grasp the foil and rip it from the can end. Another known can end assembly involves an adhesive tape seal which covers an opening in the end of the can. A metal or plastic tab is provided for breaking this adhesive seal. Additionally, various other can end assemblies are known in the prior art.

However, several of the known systems include obstructions near the can end opening. These obstructions can interfere with a consumer as he attempts to drink from the can or remove its contents. Additionally, sealing means which are detachable from the can end can create various litter problems.

Also, several of the prior art assemblies involve the introduction of portions exposed on the outside of the can into an interior portion of the can. Not only do these embodiments involve possible contamination to the can's contents, but an inherent danger resides in the fact that such portions introduced into the can might become unattached from the can. Such an unattached portion would be dangerous as it may be swallowed by a consumer. Additionally, most of the other prior art arrangements are not readily resealable.

Accordingly, a need in the art exists for a simple can end assembly which has an unobstructed opening for ease of access, interconnected members for reducing the potential for litter, a resealable opening feature, and a design wherein none of the outer portions of the can will enter the interior of the can.

SUMMARY OF THE INVENTION

Accordingly, it is a primary object of the present invention to provide an improved can end assembly. This assembly comprises an interconnected cover portion, a tear-shaped seal means, and a pull member which are all moveable relative to one another. As each of these elements are interconnected, none become disassociated from the can. As there is no separate tab, the potential for litter is reduced.

It is a further object of the present invention to provide an easy to use can end assembly having elements which are movable to an out of the way position. In particular, it is an objective to have a tear-shaped seal means which will close an opening in a cover portion of the can end assembly. This tear-shaped seal means can move from this closed position to an out of the way position for providing access to this opening. In this out of the way position, a consumer may easily drink from the can or otherwise remove its contents. Also, the possibility of cutting a user's lip may be avoided by this means moving to an out of the way position.

It is still another object of the present invention to provide a can end assembly which has movable portions which do not enter the interior of the can. As these portions are exposed to an unsterile environment, it is unappetizing to have a portion of them enter the can. Any dirt or other contaminant which are on this portion might contaminate the contents of the can. Additionally, there is a danger of this portion becoming detached from the can. An unaware consumer might swallow this portion if he drinks from the container. By maintaining all of the elements on the exterior of the can, such problems are avoided.

It is yet another object of the present invention to provide a seal means which can reseal the opening of the container. While this resealed opening is not an airtight seal (as it is when it comes from the factory), it is sufficient to avoid spillage of the contained beverage. This design enables the consumer to easily transport the container after he has opened the can but before all of the beverage is consumed. Additionally, the problem of contaminants entering an unattended container may be avoided by simply resealing the opening.

It is yet another object of the present invention to provide an all plastic can end assembly. This all plastic design permits mass production of the assembly from a single web of plastic. Additionally, transparent plastic may be used to permit the consumer to view the contents of the container and to determine the amount of beverage therein. This design also enables the can to have its openings closed by a heat seal.

It is yet another object of the present invention to provide a can end assembly which can easily snap on the sides of a can. Such a design permits quick and accurate installation of the assembly on the can.

It is still a further object of the invention to provide score lines beneath the cover portion of the can end assembly to enable the can to withstand compression forces. It is a further object of the present invention to permit proof of purchase labels to be placed beneath the pull means such as in U.S. Pat. No. 4,322,016 issued to Varrash on Mar. 30, 1982.

It is yet another object of the present invention to provide a can end assembly which will have certain safety features if the can were to explode. Specifically, if the internal pressure of the can became too high, the seal means of the can assembly would be torn from the cover means. This action would vent the interior of the can. However, the hinge attached between the seal means and cover portion would prevent the seal means from flying away from the can as a projectile. The seal means would remain attached to the lid.

It is still another object of the present invention to provide a can end assembly which is easily stacked.

It is a further object of the present invention to provide a can end assembly which is also tamper-proof.

It is an additional object of the subject invention to provide a can end assembly which has a vent opening to prevent the contents, such as a carbonated drink, from foaming upon opening of the seal means.

These and other objects of the present invention are fulfilled by providing a can end assembly including a cover portion for covering an end of the can body, said cover portion having a first opening therein, seal means for closing said first opening, said seal means being operatively connected to said cover portion adjacent the first opening by first hinge means; a pull member having first and second distal ends and two side portions, one of said two side portions having a notch therein, second hinge means connecting said pull member to the seal means, said pull member and said seal means being movable about said first and second hinge means between a first position wherein said seal means closes the first opening and a second position wherein the first opening is substantially unobstructed by said seal means; and said pull member overlaying said seal means when in the first position, said seal means overlaying the pull member and said second hinge means folding into said notch in the second position, said pull member being displaced approximately 90 degrees along a longitudinal axis thereof as said pull member moves from the first to the second position.

The further scope of applicability of the present invention will become apparent from the detailed description given hereinafter. However, it should be understood that the detailed description and specific examples, while indicating preferred embodiments of the present invention, are given by way of illustration only, since various changes and modification within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only and thus are not limitative of the present invention and wherein.

DETAILED DESCRIPTION OF THE PREFERRED EMBODIMENTS

Figure 1:
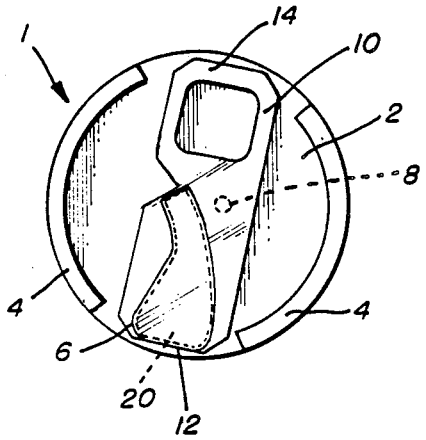
FIG. 1 is a top plan view of the can end assembly, the seal means being in a closed position.
Figure 2:
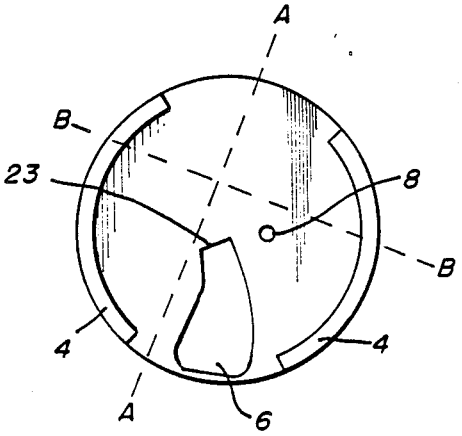
FIG. 2 is a top plan view of the can end assembly with the pull member and seal means being removed.

Referring in detail to the drawings and with particular reference to FIGS. 1 and 2, a can end assembly 1 is shown with a cover portion 2. This cover portion has two flange portions 4, partially surrounding its outer edge. The function of these flange members will be explained in greater detail hereinafter. This cover portion also has a first opening 6 and a second opening 8. The first opening is for removal of the contents of the can, while the second opening 8 is for venting the can.

Figure 3:
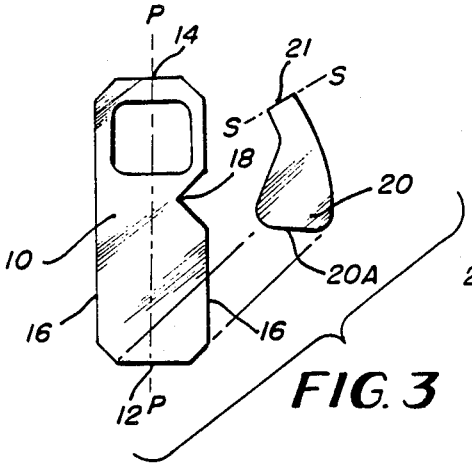
FIG. 3 is an exploded view of the pull member and seal means.

Referring now to FIGS. 1 and 3, a pull means 10 is shown having a front end 12, a rear end 14, and two side portions 16. Formed in one of the side portions 16 is a notch 18. The function of this notch will be described hereinafter. Operatively attached to the front end 12 of the pull means is a major edge 20A of a tear-shaped seal means 20. This seal means has a flat rearward section and a minor edge 21 which is operatively attached by a hinge to surface 23 (shown in FIG. 2) adjacent the first opening 6 in the cover portion 2. The cover portion 2, seal means 20, and pull member 10 are all interconnected to form a single unit. Operation of this unit will be described hereinafter.

Figure 4:
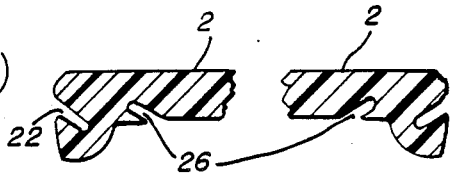
FIG. 4 is a cross-sectional view taken along line A—A of FIG. 2.
Figure 5:
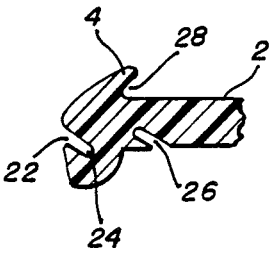
FIG. 5 is a cross-sectional view taken along line B—B of FIG. 2.

With reference to FIG. 4, a sectional view of the cover portion taken along line A—A of FIG. 2 is shown. Extending around the edge of this cover portion is a groove 22 which contains a sealing compound 24. Additionally, extending around the bottom surface of the cover portion is a score line 26. As seen in FIG. 5, this cover portion also has two flanged portions 4 as previously noted. Beneath the flange portions, is an undercut 28 whose function will be explained in connection with that of the flanged portions 4.

Figure 6:
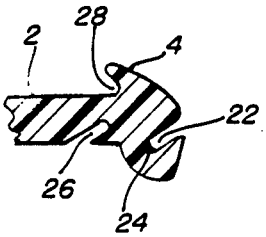
FIG. 6 is a view of the lefthand portion of the cover means as shown in FIG. 5.
Figure 6:
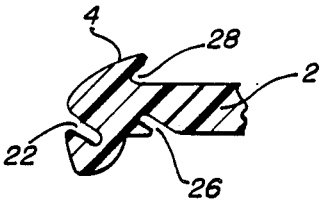
Figure 7:
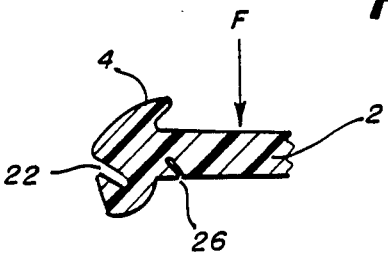
FIG. 7 is a view of FIG. 6 with a downward force being applied thereto.

As seen in FIGS. 6 and 7, the score line 26 enables the can end assembly to withstand a compression force F. The gap formed by this score line 26 will collapse when compression force F is applied to the can end assembly. This action helps to dissipate the force and permit the can end assembly to remain firmly attached to the can body.

Figure 8:
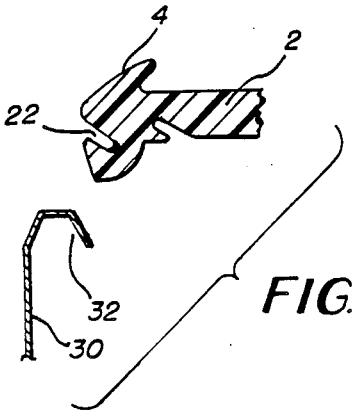
FIG. 8 is a view of FIG. 6 as the cover means approaching a can body.
Figure 9:
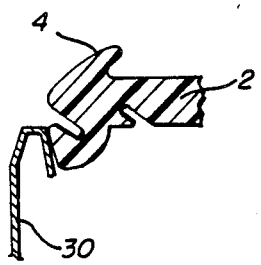
FIG. 9 is a view of FIG. 6 as the cover means contacts a can body.
Figure 10:
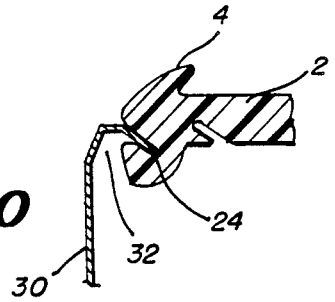
FIG. 10 is a view of FIG. 6 after the cover means has been snapped onto the can body.

In particular, the attachment of the can end assembly to the can body is shown in detail in FIGS. 8–10. As seen in FIG. 8, the cover portion 2 will approach the can body 30. This can body 30 has an inwardly disposed flange 32. As the cover portion continues to approach the can body, this inwardly disposed flange 32 is partially deflected by the outer edge of the cover portion. As seen in FIG. 10, when the cover portion reaches its final position, the inwardly disposed flange 32 will snap into the groove 22 provided in the cover portion. The sealing compound 24 provided in this groove 22 will further aid attachment of the can body to the can end assembly.

Figure 11:
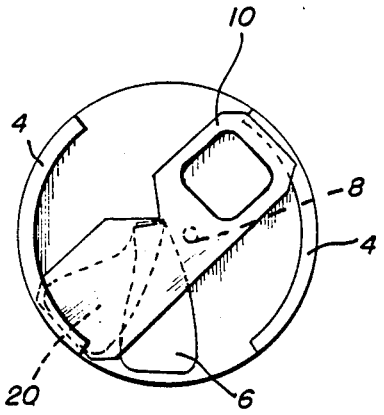
FIG. 11 is a top plan view of the can assembly in a partially opened position.
Figure 12:
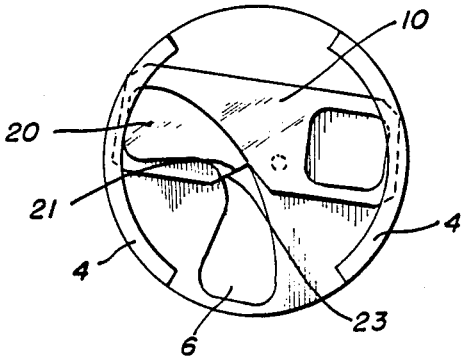
FIG. 12 is a top plan view of the can assembly in its fully open position.

Referring to FIGS. 1, 11 and 12, the opening of the can end assembly 1 will now be described. FIG. 1 shows the seal means 20 in a closed position covering the first opening 6. Additionally, the pull member 10 covers the seal means 20 as well as the second opening 8. In FIG. 11, the pull member 10 has been partially elevated in order to break the seal between the seal means 20 and the opening 6 and to partially pivot the seal means about a first hinged connection to surface 23. Due to the tear-shaped arrangement of the seal means and the diametric orientation of a minor edge thereof, it will move from a first position covering the first opening 6 as shown in FIG. 1 to a second position displaced from the opening 6 as shown in FIG. 12. This seal means pivots 180 degrees about axis SS indicated in FIG. 3. This axis not only extends through the flat rearward minor edge 21 of the seal means, but also extends through the connection surface 23 of the cover portion.

As the seal means is moving, the pull means is also moving. As previously noted, the pull means is initially lifted to break the seal between the seal means 20 and the opening 6. Due to its connection to the tear-shaped seal means at a minor edge thereof, the pull means will pivot 180 degrees about its longitudinal axis PP (indicated in FIG. 3). Initially, the pull means is positioned above the seal means 20 as seen in FIG. 1. Upon reaching the open position shown in FIG. 12, the seal means 20 is now located above the pull means 10.

As can be seen in FIG. 12 in conjunction with FIG. 5, the pull means 10 and the tear-shaped seal means 20 are both temporarily locked in the undercut portion 28 beneath the flanged portions 4. This design ensures that these elements remain in an unobstructive, open position.

This can end assembly may be made from plastic or other material. This construction permits the pull member 10 and the seal means 20 to snap beneath the flange portions. If so desired, the pull member 10 and seal means 20 may be unattached from beneath the flanged members and repivoted back to their original positions. Upon completion of this operation, the first opening 6 is again closed by the seal means 20. It is noted that this seal is not an airtight seal (as was originally provided), but is merely a temporary seal for aiding containment of the can's contents. In such a resealed position, the can is easily transported with the beverage or other contents securely contained therein.

Upon comparing FIGS. 1 and 12, it can readily be seen that the pull member 10 is not only rotated 180 degrees about axis PP but is also offset by 90 degrees. This offset feature is a result of the tear-shaped design of the seal means 20. In the FIG. 12 position, the tear-shaped seal means 20 remains attached to the cover portion 2 at the connection surface 23. The pull member is arranged to have a notch 18 in one of its side portions 16. This notch permits the seal member to also remain attached to the cover portion.

In the open location, the pull member and the seal means are in an unobstructed position with regard to the opening 6. Due to the 90 degree rotation of the pull means, it is well away from the area which may come in contact with the consumer. Additionally, the seal means 20 is also far from this area. After these elements have been temporarily locked beneath the flange portion 4, they are ensured of remaining out of the way of the consumer. This design promotes ease of consumption of the beverage, and prevents the possibility of one of these elements cutting a user's lip if he were to drink from the container.

The rotation of the seal means 20 about axis SS and the movement of the pull member to the out of the way, open position result in no structure from the outside of the container entering the interior of the can. Not only is this more aesthetically pleasing to the consumer, it also avoids the possibility of contamination to the can's contents and the inherent problems of possible detachment of elements within the container.

It should be understood that the can end assembly of the present invention may be utilized in combination with containers other than beverage cans. Also, one continuous flange rather than two separate flanges may be used on this can end assembly. While it has been noted that this can end assembly may be made of plastic material, it is contemplated that various other materials may be used in the manufacture of this assembly.

The present invention having been thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A can end assembly for attachment to a can body comprising:

a cover portion for covering an end of the can body, said cover portion having a first opening therein, seal means for closing said first opening, said seal means being operatively connected to said cover portion adjacent the first opening by first hinge means;

a pull member having first and second distal ends and two side portions, one of said two side portions having a notch therein, second hinge means connecting said pull member to the seal means, said pull member and said seal means being movable about said first and second hinge means between a first position wherein said seal means closes the first opening and a second position wherein the first opening is substantially unobstructed by said seal means; and said pull member overlaying said seal means when in the first position, said seal means overlaying the pull member and said first hinge means folding into said notch in the second position, the longitudinal axis of said pull member being displaced approximately 90 degrees as said pull member moves from the first to the second position.

2. The can end assembly as recited in claim 1 and further comprising: at least one flanged portion on said cover portion, said flanged portion engaging at least one of the first and second distal ends of the pull member when the pull member is in the second position and for temporarily locking the pull member and seal means in said second position.

3. The can end assembly as recited in claim 2, wherein said at least one flanged portion engages both the first and second distal ends of the pull member when the pull member is in the second position.

4. The can end assembly as recited in claim 1, wherein said seal means and pull member are both movable from the second position back to the first position in order for the seal means to partially reseal the first opening.

5. The can end assembly as recited in claim 1 and further comprising: a second opening provided in said cover portion, said second opening permitting venting of the can when the pull means initially begins moving from the first to the second position.

6. The can end assembly as recited in claim 1 and further comprising: a groove extending around the periphery of the cover portion for engaging an inwardly disposed flange of said can body, said groove being disposed so as to permit said can end assembly to snap onto and be retained by said can body.

7. The can end assembly as recited in claim 6 and further comprising:

a bottom and top side being provided for said cover portion; and a score line extending around the bottom of said cover portion, said score line extending upwardly and outwardly into the cover portion to form a gap therein, and said score line permitting the can end assembly to withstand a compression force applied to said cover portion.

8. The can end assembly of claim 1 wherein said can end is circular and said seal means is tear-shaped with a minor edge extending substantially diametrically of said can end, said first hinge means being connected to said minor edge, said tear-shaped seal means also having a major edge extending substantially tangentially to the periphery of said circular can end and contiguous thereto, said second hinge means being connected to said major edge.

9. The can end assembly of claim 8 wherein said first and second hinge means are formed from flexible sheet material.

10. The can end assembly of claim 9 wherein said sheet material are integral extensions of said seal means and said pull member.

* * * * *